United States Patent [19]

Hill

[11] 4,133,742

[45] Jan. 9, 1979

[54] SEPARATION OF HYDROCARBONS FROM OIL SHALES AND TAR SANDS

[76] Inventor: William H. Hill, 38 Suzanne Ave., St. Paul, Minn. 55110

[21] Appl. No.: 820,223

[22] Filed: Jul. 29, 1977

[51] Int. Cl.[2] ..... B03B 9/02

[52] U.S. Cl. ..... 208/11 R; 201/21; 210/39

[58] Field of Search ..... 208/8, 11 LE, 11 R; 201/21; 210/39

[56] References Cited

U.S. PATENT DOCUMENTS

| | | | |
|---|---|---|---|
| 2,276,342 | 3/1942 | Records et al. | 208/11 R |
| 2,589,109 | 3/1952 | Martin et al. | 208/11 R |
| 2,761,824 | 9/1956 | Eastman et al. | 208/8 |
| 2,885,275 | 5/1959 | Rees | 208/11 R |
| 3,117,072 | 1/1964 | Eastman et al. | 208/11 R |

*Primary Examiner*—Delbert E. Gantz
*Assistant Examiner*—Joan Thierstein

[57] ABSTRACT

An efficient and practical process is provided, permitting greatly increased recovery of hydrocarbons from oil shales and tar sands. Steps involved include mixing oil shale or tar sand in water, with pulverized coal, to form an amalgam, and separation of water to be reused in the process. The separated amalgam contains the hydrocarbons of the shale or sand and constituents of coal in which mineral matter content is considerably reduced.

3 Claims, No Drawings

SEPARATION OF HYDROCARBONS FROM OIL SHALES AND TAR SANDS

BACKGROUND OF THE INVENTION

In the recovery of carbonaceous content of coals in the past, aside from the use of heat, oils or liquid solvents were applied, such as, benzol, crude oil, gasoline and others. In the well known Trent process, such oils or liquids were mixed with the coal suspended in water to separate the carbonaceous matter from ash. The recovery of hydrocarbons from shale and tar sands in the past has been restricted essentially to the use of heat, with attendant combustion and severe loss of hydrocarbons. In the process claimed hereinbelow, hydrocarbon matter is separated from shale in the presence of coal but no oils or liquid hydrocarbons are used to accomplish the separation.

SUMMARY OF THE INVENTION

The present invention relates to improvements in methods of separating hydrocarbons from oil shales or tar sands with coal as an agent. There is in effect a simultaneous removal of carbonaceous matter from the coal and from the oil shale or tar sand in the course of the treatment.

An object of the invention is to provide a method of separating the hydrocarbons from the mineral constituents of oil shale or tar sand in an aqueous medium by means of coal, in which method the water is reused and the loss of water is substantially reduced in the processing of the oil shale or tar sand. Another object is to separate the hydrocarbons in oil shale and tar sand and avoiding the use of heat and combustion for the separation. Other objects and details will be apparent from the following description:

DETAILED DESCRIPTION OF PREFERRED EMBODIMENTS

Oil shale or tar sand and bituminous or subbituminous coal preferably finely divided are mixed in water to form an amalgam containing the hydrocarbons of the coal and of the oil shale or tar sand.

In a preferred process of the present invention the following steps are employed:

1. Oil shale or tar sand is ground in water.
2. Pulverized coal is added. The coal is preferably in suspension in water (slurry) when added to the material of Step 1.
3. The mixture is agitated to form an amalgam of hydrocarbons initially in the shale or sand, and in the coal.

4. The separated amalgam containing hydrocarbons from the oil shale or tar sand and from coal, is usable in subsequent treatments, such as coking, etc.

The particle size of the oil shale or tar sand and the coal may be 100 mesh or smaller. Bituminous and subbituminous coals are more suited than anthracite or lignite because the latter two coals are not likely to yield satisfactory results. The said bituminous coals and oil shales are considered to be plentiful in western United States. In some areas in which oil shales and tar sands occur, water is scarce. The processing waters from the present process may be passed into settling ponds. A considerably lower evaporation loss occurs since in the above described process an oily surface film is produced on the ponds.

Besides coking the amalgam to produce a coke product, and obtaining the oil values of the oil shales or tar sands in the form of oils and gas, the amalgam may be completely hydrogenated. Also, when the amalgam is obtained with a sufficiently high oil content, so that it flows at elevated temperatures, it is possible to deliver it by pipeline to be used as a fuel in power plants and various large industries. Serious losses of large amounts of water in coal slurry deliveries, as are currently advocated, are likely to occur.

What is claimed is:

1. A process of separating hydrocarbons from oil shales or tar sands, which process comprises grinding oil shale or tar sand in water and reducing the shale or sand to a fine particle size, adding pulverized coal to the mixture of shale or sand and water and agitating to form an amalgam which contains the hydrocarbons of the oil shale or tar sand and the coal, separating the amalgam from the resulting mixture, and further separating the water and mineral matter for reuse of the water in the process.

2. A process of separating hydrocarbons from oil shales or tar sands, which process comprises grinding oil shale or tar sand in water, adding pulverized bituminous coal in water suspension to the shale or sand suspension formed in water while simultaneously separating the carbonaceous matter from the gangue of shale or tar sand and forming an amalgam of said coal and the carbonaceous matter from said oil shale or tar sand, separating the amalgam from the water, settling out the mineral matter of the shale or sand and of the coal, and reusing the water in the subsequent treatment of oil shale or tar sand.

3. A process of separating hydrocarbons from oil shales or tar sands, which process comprises mixing finely divided oil shale or tar sand and pulverized coal in water to form an amalgam containing carbonaceous matter of the oil shale or tar sand and the coal, and separating the amalgam from the resulting mixture.

* * * * *